United States Patent [19]

Valles

[11] 4,076,293

[45] Feb. 28, 1978

[54] DOOR SECURITY STRUT

[76] Inventor: Joel Valles, 3601 W. 119th St., Alsip, Ill. 60658

[21] Appl. No.: 627,219

[22] Filed: Oct. 30, 1975

Related U.S. Application Data

[63] Continuation of Ser. No. 479,649, Jun. 17, 1974, abandoned.

[51] Int. Cl.[2] ..... E05C 17/50

[52] U.S. Cl. ..... 292/338

[58] Field of Search ..... 292/338, DIG. 15, 262, 292/277, 263, 266, 269, 273

[56] References Cited

U.S. PATENT DOCUMENTS

| | | | |
|---|---|---|---|
| Re. 27,161 | 8/1971 | Raymon | 292/338 |
| 385,668 | 7/1888 | Henninger | 292/136 |
| 544,730 | 8/1895 | Kennedy | 292/338 |
| 842,691 | 1/1907 | Palmer | 292/338 |
| 1,631,980 | 6/1927 | Piccirilli | 292/338 |
| 1,851,630 | 3/1932 | Johnson | 292/263 |
| 1,876,173 | 9/1932 | Sasgen | 292/338 |
| 1,967,592 | 7/1934 | Rawlings | 292/263 |
| 3,006,676 | 10/1961 | Germock, Jr. | 292/338 |

*Primary Examiner*—Richard E. Moore
*Attorney, Agent, or Firm*—John N. Wolfram

[57] ABSTRACT

A strut for holding a door in closed position, the strut comprising a tube and a rod threaded together so that the length of the strut is adjustable. The strut connects to a door bracket at two spaced locations whereby the strut is held in a fixed angular position relative to the door when in operating position. There is also a lock nut for locking the rod and tube to the adjusted length, a floor engaging pad swivelly connected to the tube, and one of the connections to the door bracket can be disengaged to permit swinging of the strut into a stored position against the door.

1 Claim, 4 Drawing Figures

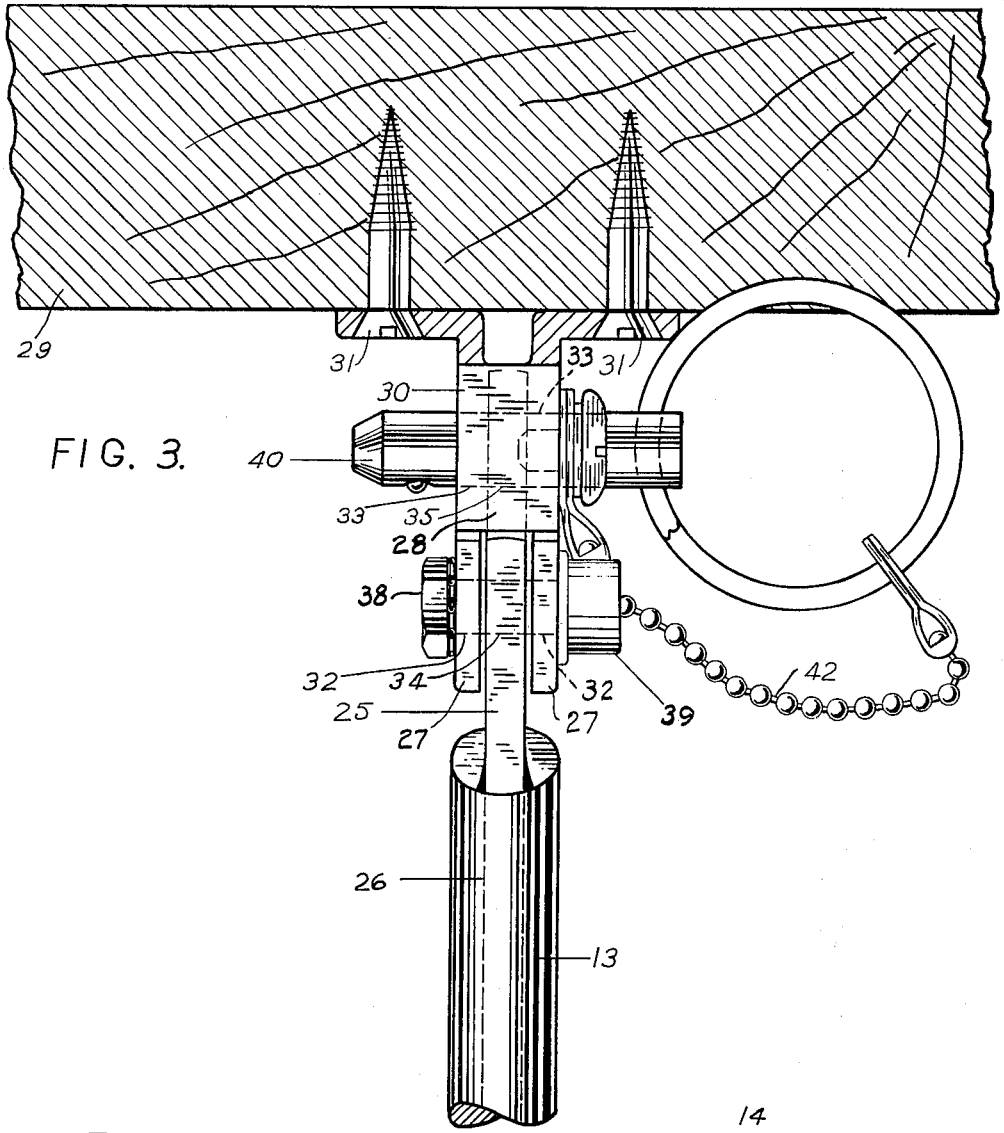
FIG. 3.
FIG. 4.
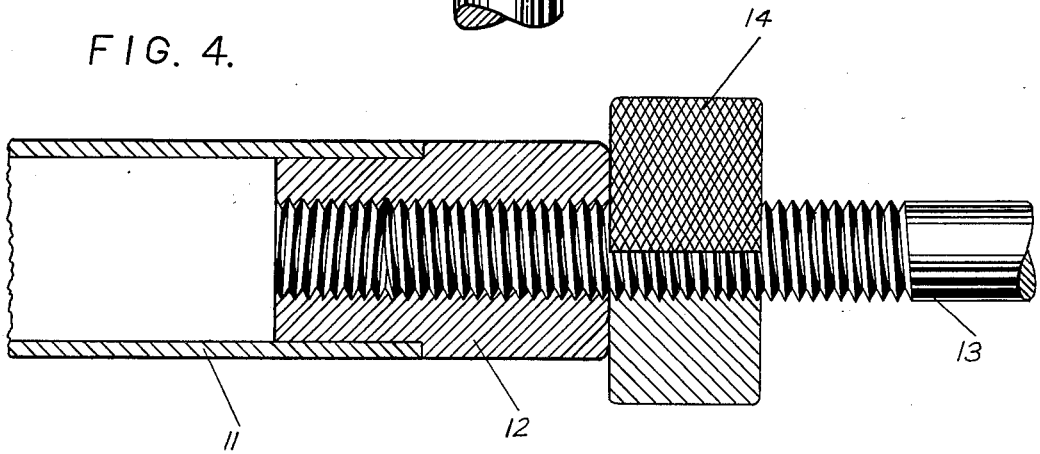

DOOR SECURITY STRUT

This is a continuation of application Ser. No. 479,649, filed June 17, 1974, now abandoned.

BACKGROUND OF THE INVENTION

Various designs for strut type devices for holding doors in closed position have been previously conceived, several such designs being disclosed in U.S. Pat. Nos. 842,691; 1,479,029; 1,505,184; 1,944,783 and 1,966,612. Such previously conceived struts lack in simplicity and/or the ability to be quickly adjusted and locked in any desired length, and/or to be positively locked in a predetermined angular relationship with the door when in operating position.

Summary of the Invention

The strut of the present invention comprises a tube and a rod threaded together so as to be infinitely adjustable in length, the tube having a floor engaging pad connected thereto by a universal swivel joint, and the rod having a pivotal connection with a bracket on the door and having a plate attached thereto that may be pinned to the door bracket for locking the strut in a fixed angular relationship to the door when in operating position and which may selectively lock the strut in a stored position against the door.

DETAIL DESCRIPTION

FIG. 3 is a view along lines 3 — 3 of FIG. 1 and shows the connection of the strut to a bracket on the door.

FIG. 4 shows the threaded connection between the rod and tube that form the strut.

Figures 1, 2:
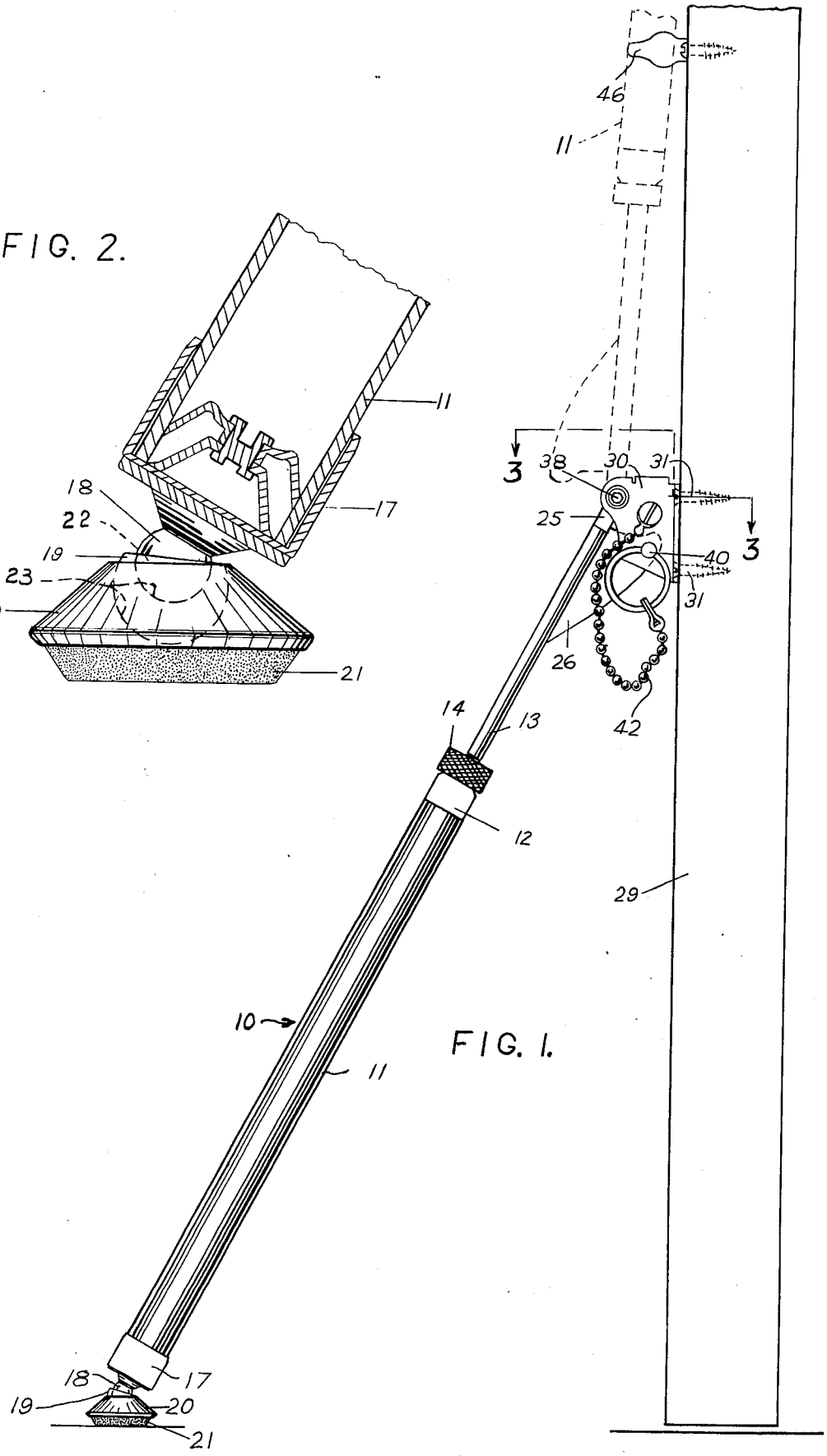
FIG. 1 shows the strut in operating position for securing a door.
FIG. 2 shows the swivel joint for connecting the strut to a floor engaging pad.

The strut 10 comprises a tube 11 having a threaded adapter 12 welded to one end and into which is threaded a rod 13 upon which a knurled nut 14 is also threaded.

The other end of the tube has an adapter 17 pressed thereon and the adapter has a spherical end portion 18 receivable within a socket member 19 in a pad 20 that has a floor engaging plastic portion 21 that is either knurled or ribbed on its bottom surface or otherwise formed to provide a non-skid engagement with the floor. Socket member 19 has a spherical recess 22 to snugly but movably receive and retain end portion 18 and likewise pad 20 has a spherical recess 23 to snugly but movably receive and retain socket member 19.

At its outer end, rod 13 is flatted on both sides to form a tongue 25 and has a plate 26 welded thereto.

A generally U-shaped bracket 30 having spaced side portions 27 connected by a transverse portion 28 is attached to the door by several screws 31. Side portions 27 have openings 32, 33 therethrough that are respectively registerable with an opening 34 in rod tongue 25 and with an opening 35 in plate 26. A suitable bolt or pin 38 secured by a nut 39 passes through holes 32, 34 and has a loose fit therein for permitting rod 13 to pivot in a vertical plane on pin 38 when the rod is not locked in either an operating or a stored position.

A locking pin 40 is insertable into openings 33 and 35 when the strut 10 is in a predetermined angular position relative to door 29 and may be removed from openings 33, 35 when it is desired to put the strut in a stored position as shown by the dotted lines in FIG. 1. Pin 40 is secured to bracket 30 by a chain 42 so that it will not become lost.

To hold the strut in the stored position against the door, a spring clip type holding bracket 46 is secured to the door and engages tube 11 for holding the strut in the position shown in the dotted lines of FIG. 1.

To utilize the strut after bracket 30, with rod 13 secured thereto by pin 38, has been mounted on the door, lock nut 14 is first backed away from tube 11. The tube is then threaded further onto the rod so that the overall length of the rod and tube is somewhat less than required for the operating position. The tube and rod are then swung downward until plate opening 35 registers with bracket openings 33. Pin 40 is then inserted into these openings to lock rod 13 in a fixed predetermined angular position relative to the bracket 30 and hence to the door. Tube 11 is then threaded along rod 13 toward the floor until pad 20 presses against the floor with sufficient force to prevent it from sliding thereon even when considerable force is exerted for opening the door. The lock nut 14 is then threaded against bushing 12 for locking the rod and tube in their lengthwise adjusted position. The strut is now in its operating position and condition.

To store the strut, lock nut 14 is backed away from bushing 12 and tube 11 is now threaded onto rod 13 until pad 20 loosens its grip upon the floor. Pin 40 is then removed from openings 35, 33 and the strut may then be pivoted upwardly about pin 38 and engaged with clip 46 for retaining the strut in a stored position. Alternatively, it may be possible to remove pin 40 without first threading tube 11 onto the rod and then swing the strut to stored position.

In minor modifications of the invention it is obvious that rod 13 and tube 11 could be interchanged so that the rod has pad 20 attached thereto and tube 11 has plate 26 attached thereto. Also, pad 20 could be attached to the tube either by a rigid connection or by a swivel that is movable only in a vertical plane. Also, plate 26 can be omitted and hole 35 now shown in plate 26 could be in the rod at a location spaced from hole 34, in which case bracket side portions would be formed to overlie such hole 35 in the rod in the operating position of the device. Alternatively, both holes 34 and 35 could be in plate 26 and with bracket 30 suitably contoured so that holes 32, 33 will be in alignment with holes 34, 35. Also, the lower portion of bracket 30 could be extended in a direction away from the door so that holes 33 are on the opposite side of rod 13 so that pin 40 when in the holes is also on the opposite side of the rod to prevent pivoting of the strut toward its stored position. In this case plate 26 is omitted.

I claim:

1. A door security strut comprising an elongated member having first and second opposite sides that are substantially straight and parallel, said member including a plate rigid with the member and extending radially from said first side, a bracket having a mounting portion adapted to be attached to a door for mounting the bracket in a fixed position on the door, said bracket having a pair of parallel side portions projecting outwardly from said mounting portion, means for attaching the member to the side portions in a first fixed non-yielding angular position relative to the bracket with the member extending downwardly and outwardly of the bracket, said attaching means including a first pivotal connection between an end of the member and said side portions, and a second connection between said plate and bracket, said second connection being spaced downwardly from said pivotal connection and comprising openings through said plate and said side portions and a locking pin insertable with a close fit through said openings to fix the plate in relation to the bracket, the member having means thereon adapted to engage a floor when the member is in said fixed angular position, said side portions being spaced apart to receive the member therebetween and to also receive the plate therebetween when the member is in said non-yielding position, said side portions being connected by a transverse portion, said plate extending toward the mounting portion in said non-yielding position of said member, said transverse portion being at the upper end of the side portions and spaced from said first pivotal connection in a direction toward said mounting portion to thereby permit the member to be swung about said first pivotal connection from said first non-yielding position to an upward substantially vertical storage position in which the plate extends in a direction away from said bracket and said second side of the member is outwardly spaced from the transverse portion whereby the plate and the member are out of contact with the transverse portion in said upward storage position of said member.

* * * * *